US008122520B2

(12) United States Patent
Wilson, II

(10) Patent No.: US 8,122,520 B2
(45) Date of Patent: Feb. 28, 2012

(54) LOWER-BODY GARMENT HAVING A SECURE WAIST ASSEMBLY

(75) Inventor: Ronald L. Wilson, II, Solana Beach, CA (US)

(73) Assignee: Jaco Athletics, LLC, Deerfield Beach, FL (US)

( * ) Notice: Subject to any disclaimer, the term of this patent is extended or adjusted under 35 U.S.C. 154(b) by 306 days.

(21) Appl. No.: 12/405,188

(22) Filed: Mar. 16, 2009

(65) Prior Publication Data

US 2010/0229284 A1 Sep. 16, 2010

(51) Int. Cl.
*A41D 1/06* (2006.01)

(52) U.S. Cl. ..... 2/237; 2/67; 2/220; 2/221; 2/236; 2/267

(58) Field of Classification Search ..... 2/237, 76, 2/220, 221, 236, 112, 309, 267, 320, 329, 2/337

See application file for complete search history.

(56) References Cited

U.S. PATENT DOCUMENTS

| | | | | |
|---|---|---|---|---|
| 441,637 | A | 12/1890 | Bloch | |
| 849,471 | A | 4/1907 | Gamble | |
| 1,691,658 | A | 11/1928 | Kennedy | |
| D86,113 | S | 2/1932 | Dwyer | |
| 1,898,606 | A | 2/1933 | Whitley | |
| 1,999,078 | A | 4/1935 | Douglas et al. | |
| 2,138,643 | A | 11/1938 | Oppenheim | |
| 2,206,505 | A * | 7/1940 | Klein | 2/237 |
| 2,663,027 | A * | 12/1953 | Posson | 2/237 |
| 2,903,707 | A | 9/1959 | Schimmel et al. | |
| 3,047,877 | A * | 8/1962 | Palazzo | 2/94 |
| 3,295,144 | A * | 1/1967 | Mengers | 2/237 |
| 3,782,375 | A | 1/1974 | Donars | |
| 3,788,314 | A | 1/1974 | Noreen | |
| 4,014,044 | A | 3/1977 | Figueroa et al. | |
| 4,134,400 | A | 1/1979 | DiMatteo | |
| D292,340 | S | 10/1987 | Sjoholm | |
| 4,811,427 | A | 3/1989 | Regan | |
| 4,922,899 | A | 5/1990 | Graff et al. | |
| 5,105,473 | A | 4/1992 | Valtakari | |
| 5,105,474 | A | 4/1992 | Skinner | |
| 5,274,854 | A | 1/1994 | Wenner et al. | |
| 5,539,926 | A | 7/1996 | Mantos | |
| 5,689,836 | A * | 11/1997 | Fee et al. | 2/465 |
| D403,400 | S | 12/1998 | Bernard et al. | |
| 5,858,013 | A * | 1/1999 | Kling | 604/386 |
| 6,041,441 | A | 3/2000 | Counts et al. | |
| 6,108,819 | A | 8/2000 | DeBaene et al. | |
| 6,532,599 | B1 | 3/2003 | Dugan | |
| 7,178,176 | B1 | 2/2007 | S-Cronenbold | |

(Continued)

FOREIGN PATENT DOCUMENTS

| | | |
|---|---|---|
| JP | 09021006 | 1/1997 |

(Continued)

*Primary Examiner* — Khoa Huynh
*Assistant Examiner* — Alissa Tompkins
(74) *Attorney, Agent, or Firm* — Dan M. DeLaRosa

(57) ABSTRACT

A lower-body garment is provided having a secure waist assembly. The garment includes an outer shell having a waistband. The waist assembly is attached to the interior side of the waistband at a prescribed location on the waist assembly with the remaining portions of the waist assembly being free of the outer shell. The waist assembly includes an intermediate section, end sections, and end fasteners, which cooperate to promote a secure and comfortable waist fit. When secured in place, the waist assembly wraps snuggly against the waist of the wearer.

20 Claims, 3 Drawing Sheets

U.S. PATENT DOCUMENTS

| | | | | |
|---|---|---|---|---|
| 7,216,371 | B2 | 5/2007 | Wong | |
| 7,296,307 | B2 | 11/2007 | Atwater et al. | |
| 7,404,216 | B1 | 7/2008 | Paramore | |
| 7,418,743 | B2 | 9/2008 | Tsujimoto | |
| 7,523,508 | B2 | 4/2009 | Contant et al. | |
| 2004/0024341 | A1 | 2/2004 | Jacobs | |
| 2005/0066424 | A1 | 3/2005 | Salazar | |
| 2005/0229293 | A1 * | 10/2005 | Miller | 2/403 |
| 2005/0268387 | A1 | 12/2005 | Wong | |
| 2006/0156450 | A1 * | 7/2006 | McGrath | 2/114 |
| 2008/0271229 | A1 | 11/2008 | Steszyn et al. | |

FOREIGN PATENT DOCUMENTS

| | | |
|---|---|---|
| JP | 2001248005 | 9/2001 |
| JP | 03-092331 | 3/2003 |
| WO | WO-0224011 | 3/2002 |
| WO | WO 2004-000051 | 12/2003 |

* cited by examiner

LOWER-BODY GARMENT HAVING A SECURE WAIST ASSEMBLY

FIELD OF THE INVENTION

The present invention relates generally to garments for the lower body and, more particularly, such garments having a waist assembly configured for a secure and comfortable fit.

BACKGROUND OF THE INVENTION

The fit of a garment around the waist of the wearer is an important design consideration. This is particularly true for garments used in sports. A proper fit can contribute to an athlete's performance, whereas an improper fit can hamper performance.

Certain activities such as combat sports such as mixed martial arts (MMA) and water sports such as surfing can be particularly challenging for the design of the garment having a secure waist fit. In situations encountered while participating in such activities, tugging, water currents, or other forces tend to pull the garment downward, risking inadvertent removal of the garment or otherwise challenge a secure waist fit. Moreover, exposure to water or perspiration can adversely influence the waist fit, exacerbating the risk.

Current approaches for a secure waist fit typically require substantial, bulky material around the waist, which can be uncomfortable and unsightly. Thus, the wearer must often time sacrifice a secure waist fit for comfort and better looking fit or sacrifices the comfort and look for a secure waist fit.

It should be appreciated that there remains a need for a garment that addresses these concerns. The present invention fulfills this need and others.

SUMMARY OF THE INVENTION

In general terms, the invention discloses a garment having an outer shell and a waist assembly. The outer shell includes a waistband, and the waist assembly is attached to the interior side of the waistband at a prescribed location on the waist assembly with the remaining portions of the waist assembly being free of the outer shell. The waist assembly can include an intermediate section, end sections, and end fasteners, which cooperate to promote a secure and comfortable waist fit. When secured in place, the waist assembly wraps snuggly against the waist of the wearer.

In one embodiment of the invention, the waist assembly is coupled to the inner side of the waistband of the outer shell. The waist assembly includes an intermediate section positioned to be proximate to the backside of the wearer's when worn, a grip portion secured to the intermediate section and positioned to contact the wearer, and end fasteners coupled to opposing sides of the intermediate section, the end fasteners configured to attach to each other in the front side of the wearer inside the waist band, to secure the waist assembly around the waist of the wearer.

In a detailed aspect of another embodiment, the attachment between the outer shell and the waist assembly can be confined to an upper region of the intermediate section, proximate to the upper edge thereof. In such configurations, stitching can be used that extends substantially the entire length of the intermediate section. Alternatively, attachment means can be interspersed along the length of the intermediate section, proximate to the upper edge.

In another detailed aspect of yet another embodiment, the intermediate section has sufficient length to extend across a substantial portion of the wearer's back along the waist area and preferably between about 60 degrees to 300 degrees and, more preferably at least 160 degrees about the wearer, as centered on the midpoint of the back portion of the waistband. In selected embodiments, the length of the intermediate section extends at least about 180 degrees about the wearer.

In yet another detailed aspect of still another embodiment, the waist assembly includes an intermediate section formed of stretch material, such as two-way stretch material, and two end sections formed of non-stretch material disposed on opposing side ends of the intermediate section. The intermediate section is positioned proximate to the backside of the wearer, with the end sections proximate to the sides of the wearer. End fasteners, such as tie strings, extend from each of the end sections, and secure to each other in front of the wearer.

In yet another detailed aspect of still yet another embodiment, grip portions are disposed on the intermediate section to contact the wearer. The grip portion can be formed of material such as thermoplastic rubber (TPR) or silicone material. In a further embodiment, the grip portions are formed by silicone material printed onto the intermediate section.

In an independent aspect of the invention, a garment worn on the lower body is provided having an outer shell having a waistband and defining a pair of leg openings and an interior pocket disposed on an interior side the outer shell proximate to one of the leg openings of the outer shell such that the interior pocket can be accessed through the leg opening, while worn.

In a detailed aspect of another further embodiment, an opening to the interior pocket spaced apart from a bottom edge of the outer shell and includes a flap that extends over the pocket opening.

In another detailed aspect of yet a further embodiment, the pocket is disposed on a front half of the outer shell. Alternatively, the pocket can be disposed on a rear half of the outer shell.

BRIEF DESCRIPTION OF THE DRAWINGS

Embodiments of the present invention will now be described, by way of example only, with reference to the following drawings in which.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figure 1:
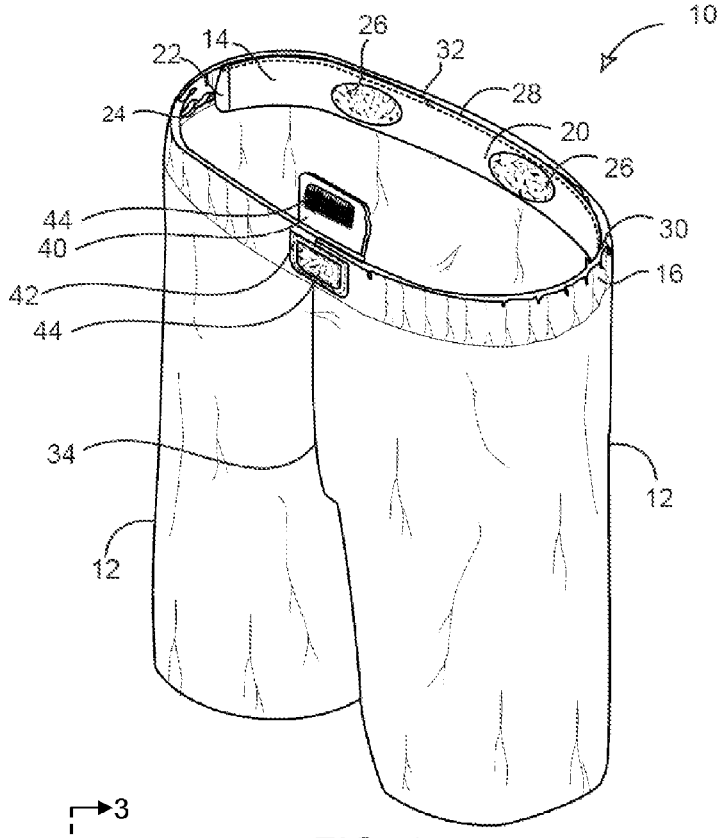
FIG. 1 is a front perspective view of a garment in accordance with the present invention, depicting a waist assembly attached to an interior side of a waistband of an outer shell.
Figure 2:
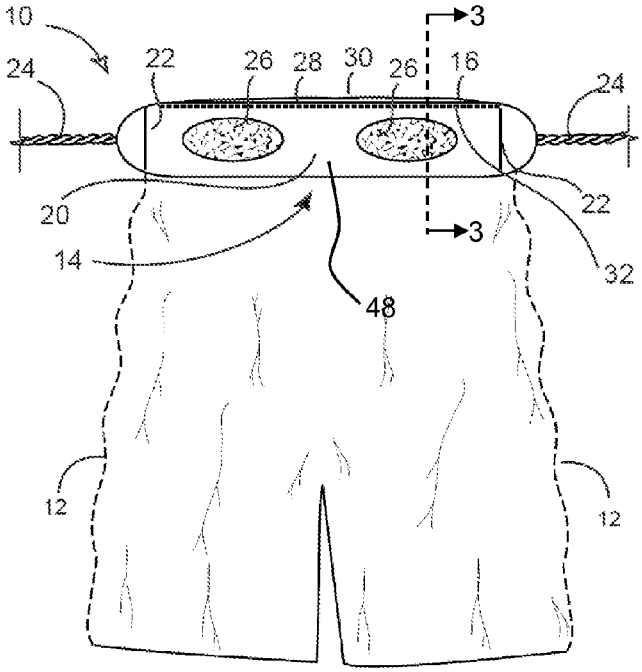
FIG. 2 is a rear cut-away view of depicting the waist assembly of the garment of FIG. 1.

Referring now to the drawings, and particularly to FIGS. 1 and 2, there is shown a garment, i.e., athletic shorts 10, having an outer shell 12 and a waist assembly 14. The outer shell 12 includes a waistband 16 that defines a waist opening. The waist assembly is attached to the interior side of the waistband at a prescribed location on the waist assembly with the remaining portions of the waist assembly being free of the outer shell. The waist assembly includes an intermediate section 20, end sections 22, and end fasteners 24, which cooperate to promote a secure and comfortable waist fit. When secured in place, the waist assembly wraps snuggly against the waist of the wearer.

In use, the wearer secures the end fasteners 24 together such that the end sections 22 hold intermediate section snug against wearer. The waist assembly 14 further includes grip portions 26 secured to the intermediate section 20. The grip portions are configured to maintain the shorts in place, by promoting secure contact against thee wearer. In this manner, the shorts maintain a secure fit in across many situations, even when exposed to perspiration or water. As a result, the shorts are particularly effective for combat sports such as martial arts, wrestling, and mixed martial arts, as well as, for water sports such as surfing.

With reference to FIG. 2, the waist assembly 14 includes two grip portions 26 disposed on the intermediate section 20. The grip portions are positioned to contact the wearer on opposing sides of the wearer's spine. In one embodiment, the grip portions are permanently attached via sonic welding; nonetheless, other means of attachment can be used such as printing, sewing, heat transfer, adhesives, and so on. The grip portions are formed of material having a measure of tackiness, such as thermoplastic rubber (TPR) material to aid in maintaining as secure waist fit. In other embodiments, silicone material such as silicone pads can be used and can be applied via printing onto the intermediate section or other attachment methods. Other materials providing sufficient tackiness can be used, such as rubber or manmade synthetic material.

The grip portions 26 are sufficiently sized to provide a substantial surface area for contact with the wearer. In another embodiment, the grip portions have a generally oval shape having a longitudinal axis aligned with the upper edge of the waist assembly. Each grip portion has a length between about 3 inches and about 10 inches, and in the exemplary embodiment of about 7 inches. The width of each grip portion is between about 1 inch and 5 inches, and the exemplary embodiment has a width of about 3 inches.

In other embodiments, grip portions can be provided in other shapes, sizes, and numbers without departing from the invention. For example, the grip portions can be configured as a plurality of cross-hatched lines or aligned geometric shapes of grip material spaced along the intermediate section of waist assembly. Alternatively, a single grip portion of a prescribed shape and size can be used.

The intermediate section 20 of the waist assembly 12 is formed of stretch material such as stretch fabric. In yet another embodiment, it is formed of two layers of four-way stretch fabric such as spandex. Alternatively, the intermediate section can be formed of two-way stretch material, used in single or multiple layers. In such embodiments, the two-way stretch material can be oriented to stretch laterally around with waist. In use, the intermediate section is stretched snuggly against the wearer, facilitating a comfortable and secure waist fit. As a result, the grip portions are held against the wearer, further ensuring a secure fit. In other embodiments, non-stretch fabric, whether single or multiple layers, can be used.

Figure 3:
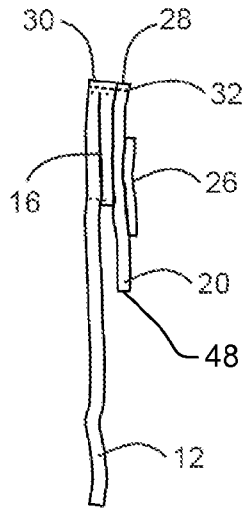
FIG. 3 is a detailed cross-sectional view of the waist of the garment of FIG. 1, taken along line 3-3 of FIG. 2, depicting the waistband and the waist assembly.

With reference now to FIG. 3, the upper edge 28 of the intermediate section 20 is preferably aligned with or slightly below the upper edge 30 of the waistband 16 of the outer shell. The intermediate section is coupled to the waistband proximate to the upper edge via stitching 32. The stitching extends substantially the entirely length of the intermediate section. In other embodiments, the stitching can be interspersed across the length of the intermediate section, or positioned in one or more prescribed locations. The lower edge 48 of the waist assembly 14 is not attached to the outer shell. Thus, when the waist assembly is secured in place, it is free to conform against the waist of the wearer.

Alternatively, other means of attaching the intermediate section to the waistband can be used, such as, hook-and-loop material, buttons, snaps, zippers, tie strings, and so on. In addition, intervening material can be used to couple the intermediate section to the waistband. For example, a section of non-stretch material can be used between the waistband and the intermediate section, to which the intermediate section and the waistband are attached.

With reference again to FIG. 2, the intermediate section 20 has a width between about 3 inches and about 10 inches and, in still another embodiment, the width is about 5 inches. The intermediate section, as shown, is generally rectangular with a constant width profile, however a variable width can be used in other embodiments.

The intermediate section 20 has sufficient length to extend across a substantial portion of the wearer's back along the waist area and preferably between about 60 degrees to 300 degrees and, more preferably at least 160 degrees about the wearer, as measured in an equal manner about the midpoint of the back portion of the waistband. In still yet another embodiment, the length of the intermediate section 20 is a function of the waist circumference of the shorts, extending about 180 degrees about the wearer.

The end sections 22 are coupled to opposing ends of the intermediate section 20. The end sections are formed of non-stretch material as compared to the intermediate section. In the exemplary embodiment, the end sections are formed a polyester fabric, such as, nylon webbing. However, other materials and configurations can be used, such as cotton, polyester, rayon, bamboo, hemp, and others. The end sections prevent the four-way stretch material from bunching by creating an equal pulling force when tightened. The end sections 22 have the same width as the intermediate section to which they are attached via stitching.

As mentioned above, the intermediate section 20 is sewn to the waistband 16 of the outer shell 12. The end sections are not directly attached to the waistband 16. Instead, the end sections are free to provide a smooth stretch of the intermediate section by securing the end fasteners together.

With continued reference to FIG. 2, each end fastener 24 extends from a corresponding end section 22. The end fasteners are configured as tie strings having sufficient length so that they can be tied to each other in the front side of the wearer proximate to the fly opening 34. In other embodiments, other configurations of fasteners can be used to stretch the intermediate section so that it is secure against the wearer. For example, the end fasteners can be configured as straps extending from the end section in which the straps having hook-and-loop material, clasps, buttons, or other means of attaching to each other. The tie strings can be of varying sizes and materials, such as cotton, polyester, rayon, bamboo, hemp, and others.

Figure 4:
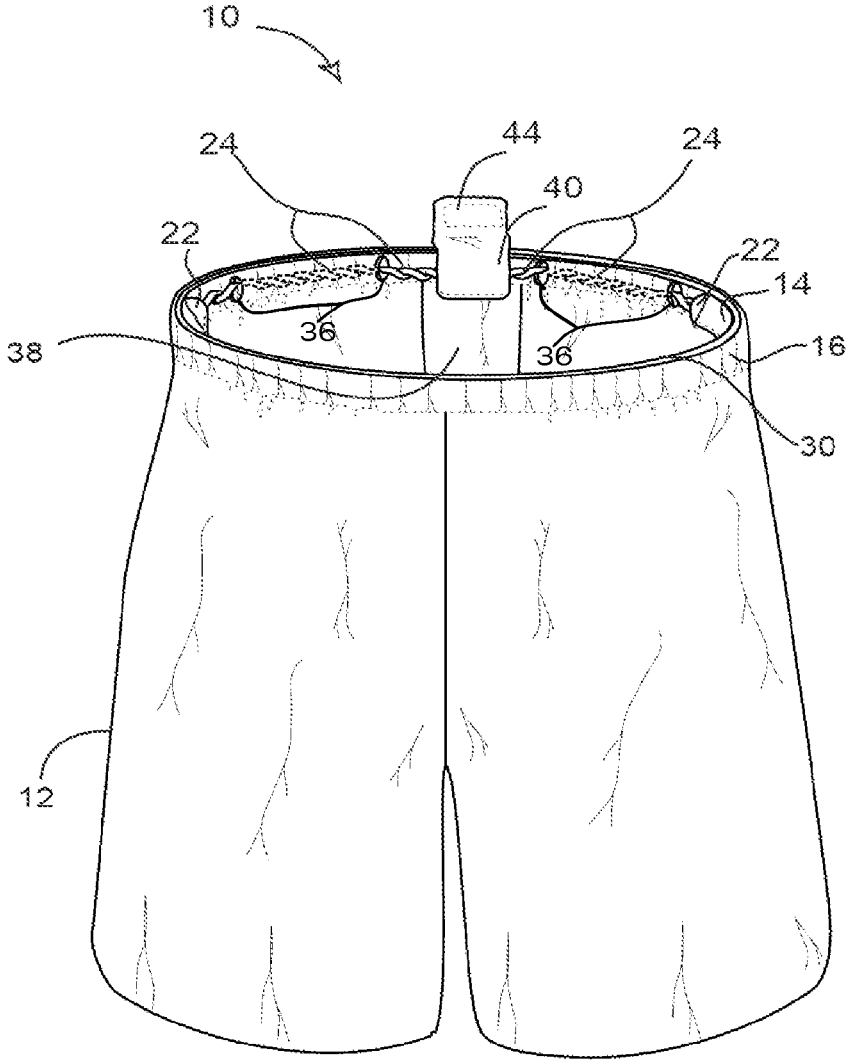
FIG. 4 is rear perspective view of the garment of FIG. 1, depicting a fastener cover and holes in the waistband for receiving tie strings.

With now to reference to FIG. 4, a plurality of holes 36 are defined on an interior side of the shorts proximate to the upper edge thereof, proximate to the fly opening 34. The holes positioned to be threaded with the end fasteners 24 of the waist assembly 14. Selected holes are cooperatively defined by the waistband and a fly panel 38 disposed behind the fly opening.

The athletic shorts 10 further include a fastener cover 40 for protecting the end fasteners 24 of the waist assembly 14. The cover is attached to an interior side of the shorts proximate to an upper edge thereof via stitching. In a further embodiment, the cover is formed of an elastomeric material, such as neoprene, disposed between two outer layers or one layer formed of fiber material such as spandex. The fastener is configured to fold over the upper edge of the waistband to cooperate with a fly closure 42 (FIG. 1) disposed on the front side to secure the cover in place.

More particularly, the fastener cover 40 includes a complementary side of hook-and-loop material 44 to mate with a corresponding portion on the fly closure 42 (FIG. 1). In use, the wearer ties the strings 24 together then folds the cover over the knot and secures fastener to the fly closure, over the upper edge of the waistband. Thus, the cover not only aids in keeping the knot tied but also provides a measure of comfort for the wearer. This is particularly effective for surfing shorts, since surfers tend to lie on a surfboard for extended periods.

With continued reference to FIG. 4, the fly panel 38 is disposed over an interior side of the fly opening 34. In another further embodiment, the fly panel is formed of two layers of four-way stretch fabric and is attached to the interior side of the outer shell extending across the fly opening. The fly panel is secured in place via stitching. In other embodiments, various other materials and securement methods can be used for the fly panel, or it can be excluded entirely.

In the present example, the fly closure 42 is formed of hook-and-loop material disposed on opposing sides of the fly opening substantially the entire length of the opening. In other embodiments, various other materials and securement methods can be used for the closing the fly opening without departing from the invention. Alternatively, shorts in accordance with the invention can exclude a fly opening entirely.

In still a further embodiment, the outer shell 12 is formed of multiple components. The waistband 16 is formed of a non-stretch material such as polyester. The outer shell further includes front panels disposed below the waistband formed of stretch fabric. In the exemplary embodiment, the elastic material is formed of stretch fabric, such as spandex; however, other materials and construction providing elastic properties can be used. In other embodiments, the material and configuration of the outer shell can be selected to suit a particular application such as surfing, combat sports, cross training, and so on. For example, the garment in accordance with the invention can be configured a particular type of garment such as surfing shorts, MMA shorts, general athletic shorts, training shorts, track shorts, training sweat pants, track pants, workout pants, and to name a few.

Figure 5:
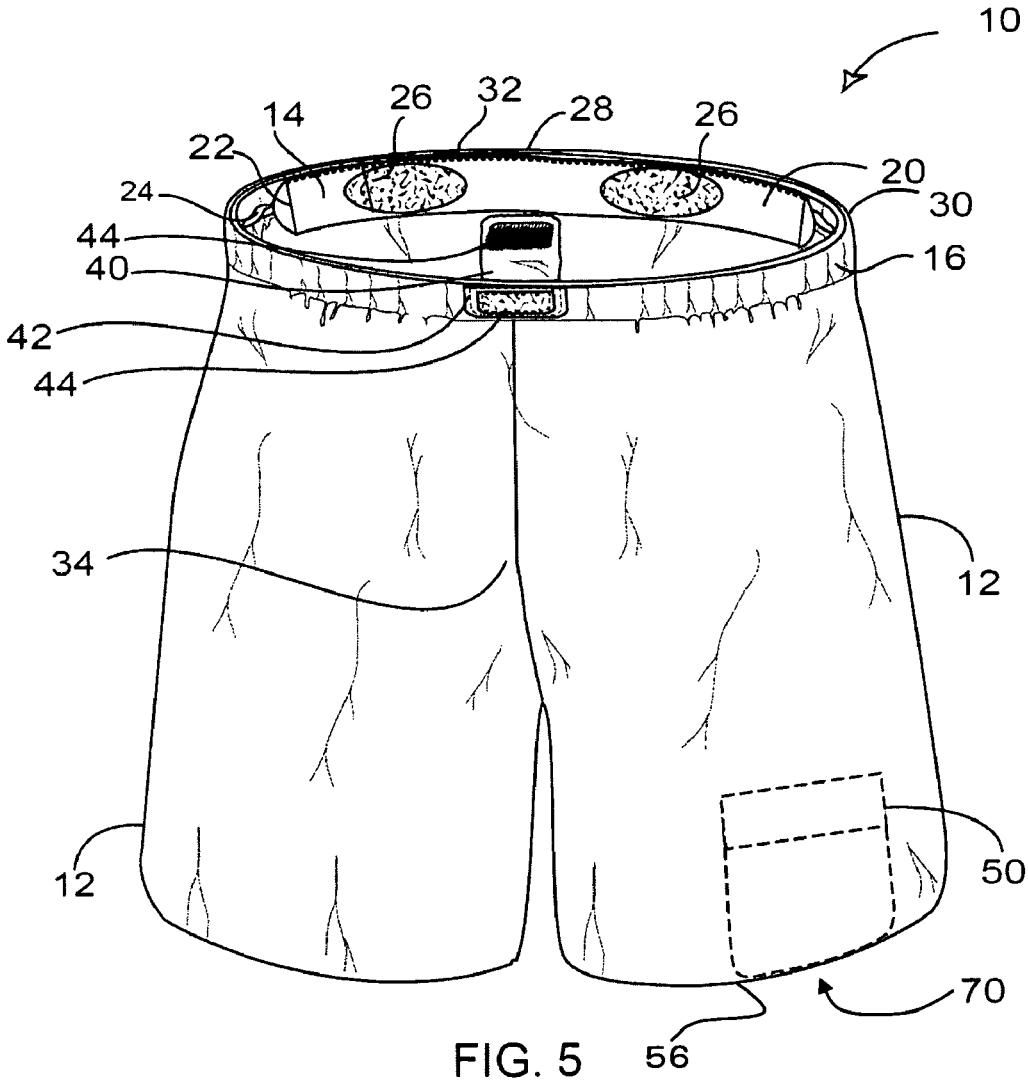
FIG. 5 is a front perspective view of the garment of FIG. 1, depicting an interior pocket in phantom located proximate to the left leg opening of the garment.
Figure 6:
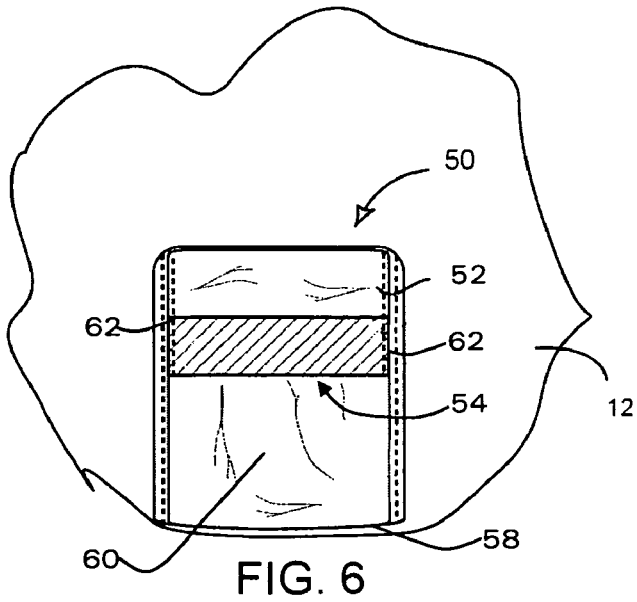
FIG. 6 is an isolated view of the interior pocket of FIG. 5, as viewed from an interior side of the leg of the garment.

With reference now to FIGS. 5 and 6, the shorts 10 further include an interior pocket 50 disposed on an interior side of the outer shell proximate to one or more of the leg openings of the outer shell. More particularly, the pocket is sewn onto the interior side of the front leg panel of the outer shell. The pocket includes a flap 52 that extends over a pocket opening 54, which is spaced apart from the bottom edge 56. In other embodiments, such as surf shorts, the pocket can be located on the interior side of the back leg panel.

In yet a further embodiment, the pocket 50 is formed of stretch material (e.g., four-way stretch material such as spandex). The pocket includes a first piece of stretch material folded along a bottom fold 58, forming a front portion 60 and a back panel (not shown), and further includes a second piece of stretch material, forming the flap 52. The side edges 62 of the flap are sewn in place to aid in securing the items within the pocket. Alternatively, other types of enclosures for internal pockets may be used, including hook and loop, buttons, zippers, snaps and so on. Stitch lines secure the pocket to the outer shell.

In use, the wearer can easily access the pocket through the leg opening 70. The pocket is sized to secure a mouth guard, such as those used in combat sports. In one example, the pocket is approximately 5 inches by 6 inches. The location of the pocket on an interior side proximate to the leg opening is advantageous in that the pocket is free of externally exposed portions and that the user need not loosen or alter the waistband to gain access to the internal pocket.

It should be appreciated from the foregoing that the present invention provides a garment having an outer shell and a waist assembly. The outer shell includes a waistband that defines a waist opening. The waist assembly is attached to the interior side of the waistband at a prescribed location on the waist assembly with the remaining portions of the waist assembly being free of the outer shell. The waist assembly includes an intermediate section, end sections, and end fasteners, which cooperate to promote a secure and comfortable waist fit. When secured in place, the waist assembly wraps snuggly against the waist of the wearer.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A garment comprising:

a waistband that circumscribes the wearer, said waistband having an outer side and an inner side, said garment having a pair of legs defining a pair of leg openings; and a waist assembly coupled to said inner side of said waistband of said garment said waist assembly comprising a planar intermediate section formed of stretch material disposed in an intermediate region of said waist assembly positioned to be proximate to the backside of the wearer when worn, said intermediate section having a length sized to extend across a substantial portion of the wearer's back along the waist area, between about 60 degrees to 300 degrees, said intermediate section having an upper longitudinal portion extending the length of said intermediate section proximate to an upper edge of said intermediate section and a lower longitudinal portion extending the entire length of said intermediate section proximate to a lower edge of said intermediate section, said intermediate section is attached to said inner side of said waistband, wherein attachment of said intermediate section to said waistband is confined to said upper longitudinal portion in such a manner as to inhibit longitudinal movement of said intermediate section relative to said waistband, a grip portion secured to an inner side of said intermediate section to contact the wearer, and end fasteners coupled to opposing ends of said intermediate section, said end fasteners configured to attach to each other in said front side of the wearer; to thereby secure said waist assembly around the waist of the wearer.

2. A garment as defined in claim 1, wherein said waist assembly is secured to said waistband by stitching disposed in said upper longitudinal portion of said intermediate section proximate to an upper edge of said waistband.

3. A garment as defined in claim 2, wherein all stitching that attaches said waist assembly to said waistband is confined to said upper longitudinal portion of said intermediate section of said waist assembly.

4. A garment as defined in claim 1, wherein said end fasteners comprise a first tie string and a second tie string.

5. A garment as defined in claim 4, wherein said waistband of said garment defines a plurality of holes proximate to said upper edge thereof, said holes positioned to receive said first and said second tie strings of said waist assembly.

6. A garment as defined in claim 1, wherein an interior pocket is disposed on an interior side of said garment.

7. A garment as defined in claim 6, wherein said interior pocket defines a pocket opening spaced apart from a bottom edge of said garment and includes a flap that extends over said pocket opening.

8. A garment as defined in claim 1, further comprising a fastener cover disposed on said interior side of the front of said garment proximate to said upper edge thereof, said fastener cover configured to fold over said upper edge of said waistband and couple to said outer side of said garment such that said fastener cover can be disposed between said end fasteners and the wearer.

9. A garment as defined in claim 1, wherein said grip portion comprises of material selected from a group consisting of thermoplastic rubber (TPR) and silicone material.

10. A garment as defined in claim 1, wherein said intermediate section is formed of two-way stretch material.

11. A garment comprising:

a waistband that circumscribes the wearer, said waistband having an outer side and an inner side, said garment having a pair of legs defining a pair of leg openings; and a waist assembly coupled to said inner side of said waistband of said garment, said waist assembly comprising a planar intermediate section formed of stretch material disposed in an intermediate region of said waist assembly positioned to be proximate to the backside of the wearer when worn, said intermediate section having a length sized to extend across a portion of the wearer's back along the waist area; between about 60 degrees to 300 degrees, said intermediate section having an upper longitudinal portion extending the length of said intermediate section proximate to an upper edge of said intermediate section and a lower longitudinal portion extending substantially the entire length of said intermediate section proximate to a lower edge of said intermediate section, said intermediate section is attached to inner side of said waistband, wherein attachment of said intermediate section to said waistband is confined to said upper longitudinal portion in such a manner as to inhibit longitudinal movement of said intermediate section relative to said waistband, a first end section and a second end section attached to opposing ends of said intermediate section, respectively, and end fasteners coupled to said end sections, said end fasteners configured to attach to each other in the front side of the wearer to secure said waist assembly around the waist of the wearer.

12. A garment as defined in claim 11, wherein said end fasteners comprise a first tie string and a second tie string coupled to said first end section and the second end section, respectively.

13. A garment as defined in claim 12, wherein said waistband of said garment defines a plurality of holes proximate to said upper edge thereof, said holes positioned to receive said first and said second tie strings of said waist panel assembly.

14. A garment as defined in claim 12, further comprising a fastener cover disposed on said inner side of said garment proximate to the upper edge thereof, said fastener cover configured to fold over said upper edge of said waistband and couple to said outer side of said garment such that said fastener cover can be disposed between said end fasteners and the wearer.

15. A garment as defined in claim 11, wherein said stretch material is four-way stretch fabric.

16. A garment as defined in claim 11, further comprising a grip portion secured to said intermediate section positioned to contact the wearer, said grip portion comprises material selected from a group consisting of thermoplastic rubber (TPR) and silicone material.

17. A garment as defined in claim 16, wherein an interior pocket is disposed on an interior side of said garment proximate to one of said leg openings of said garment.

18. A garment as defined in claim 17, wherein said interior pocket defines a pocket opening spaced apart from a bottom edge of said garment and includes a flap that extends over said pocket opening.

19. A garment as defined in claim 11, wherein said waist assembly is secured to the waistband by stitching disposed in said upper longitudinal portion of said intermediate section proximate to an upper edge of said waistband.

20. A garment as defined in claim 19, wherein all stitching that attaches said waist assembly to said waistband is confined to said upper longitudinal portion of said intermediate section of said waist assembly.

* * * * *